United States Patent [19]

Groetzinger

[11] Patent Number: 5,026,128

[45] Date of Patent: Jun. 25, 1991

[54] TOY BOX WITH SMALL PART SIFTER

[76] Inventor: Charles R. Groetzinger, 904 Montclair Dr., Racine, Wis. 53402

[21] Appl. No.: 390,633

[22] Filed: Aug. 7, 1989

[51] Int. Cl.[5] ..... A47J 43/22

[52] U.S. Cl. ..... 312/210.5

[58] Field of Search ..... 51/270; 312/229, 230, 312/210.5, 212

[56] References Cited

U.S. PATENT DOCUMENTS

| | | | |
|---|---|---|---|
| D. 282,032 | 1/1986 | Lemmeyer | D6/440 |
| 509,653 | 11/1893 | Coleman | 312/210.5 |
| 890,005 | 6/1908 | Wright | 51/270 |
| 2,660,313 | 11/1953 | James | 312/229 |
| 4,316,645 | 2/1982 | Korwin | 312/229 X |
| 4,456,316 | 6/1984 | Lundgren | 312/229 |
| 4,682,827 | 7/1987 | Woodward | 312/231 |
| 4,799,744 | 1/1989 | Toy | 312/229 |

*Primary Examiner*—Joseph Falk

[57] ABSTRACT

An improved Toy Box comprised of a container in which to store toys with a grill structured subfloor that permits small toys to fall through to a drawer below while hodling larger toys above.

12 Claims, 3 Drawing Sheets

TOY BOX WITH SMALL PART SIFTER

This invention relates to storage boxes, more specifically to boxes in which toys are stored, although it is well suited for any storage situation where both large and small parts are stored in one container.

Storage of childrens toys is an ageless problem that has partially been solved through the use of a large box in which to place toys of all sizes. Many different shapes and sizes of toy boxes have been designed, with the shapes taking the form of trucks, cars, footballs and many other eye catching configurations. Many different hinges and catches have been designed to keep lids from crashing down on small fingers.

With the advent of plastics and improved die casting techniques, more and more small parts have become an integral part of specific toy systems. Through a combination of the laws of gravity and physics, large toys tend to bind against one another and small toys tend to fall through to the bottom of the toy box. When a child elects to play with a particular toy, it is a simple matter to find the large piece of the toy system, but when it comes to locating the small parts of that system, it usually requires removal of all of the large toys in the box to get at the bottom layer of small parts.

Heretofore, people have accepted this dilemma as a matter of course, and prior art shows nothing in the way of addressing the problem.

Accordingly, the objects and advantages of this invention are to create a storage box with a reticulated or grill style subfloor with openings large enough to allow small parts to fall through, but small enough to hold the large pieces up.

Another object of this invention is to create a storage box with a drawer beneath the subfloor in which to catch the small parts falling through and provide easy access to these parts.

A further object of this invention is to create a drawer that will not hang up on large parts that are small enough to fit through the subfloor opening, but are too long to allow them to fall all the way through.

It is also an important object of the invention to provide a drawer with a back guard that will not allow small parts to fall behind the drawer when the drawer is in an open state.

Further objects and advantages of this invention will become apparent from a consideration of the drawings and the ensuing description of it.

DRAWING DESCRIPTIONS

Figure 3:
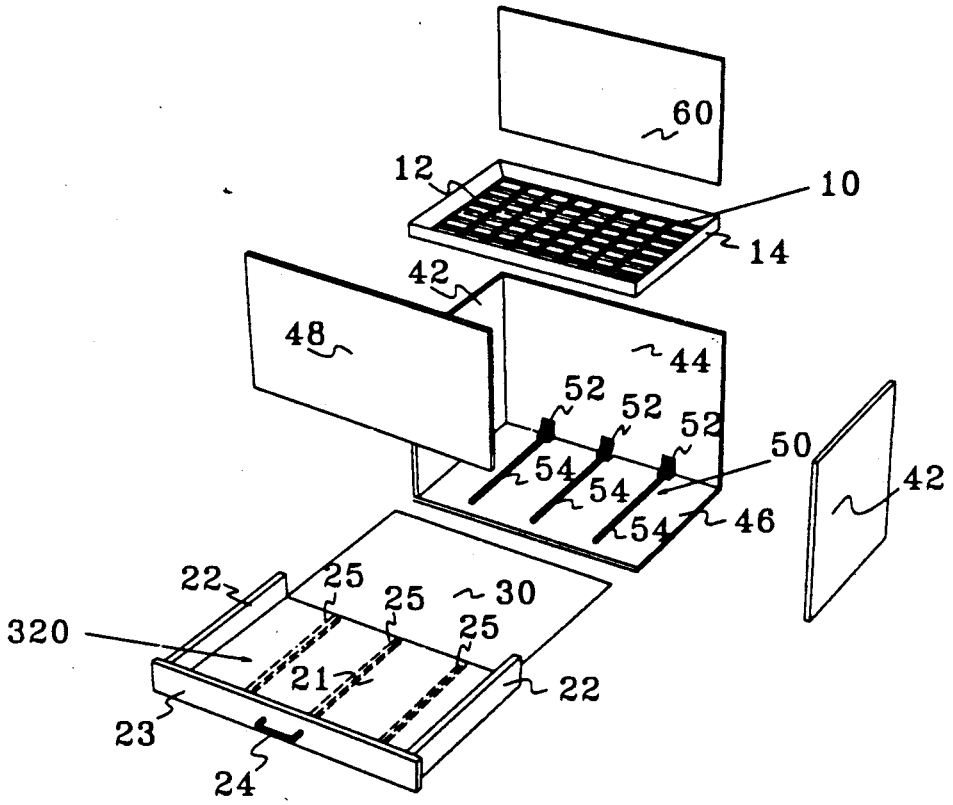

FIG. 3 shows an exploded view of the toy box. The drawer has a stiffened shroud at the rear to catch objects falling through when the drawer is open. Shroud and drawer guides are pictured on the floor of the box.

Figure 4:
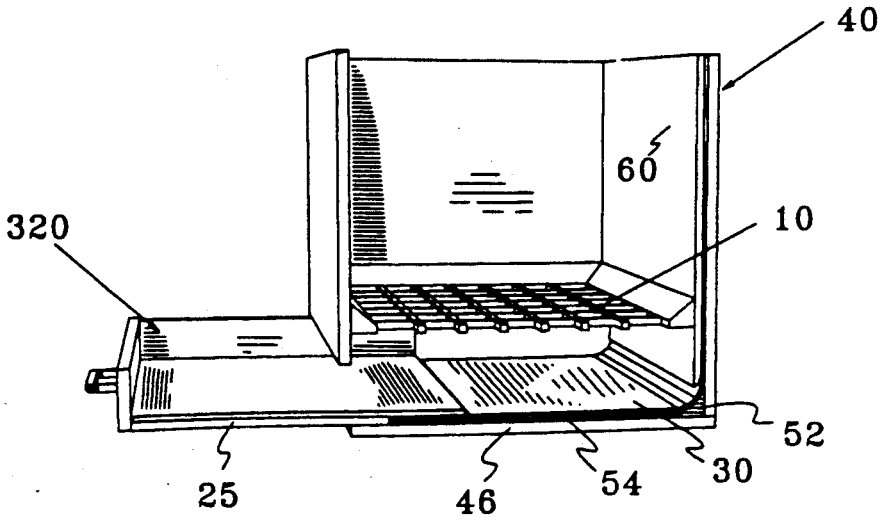

FIG. 4 shows an upper right hand perspective view of the toy box with the right side cutaway. The drawer is elongated with a flexible shroud to catch parts that may fall through when the drawer is open.

Figure 5:
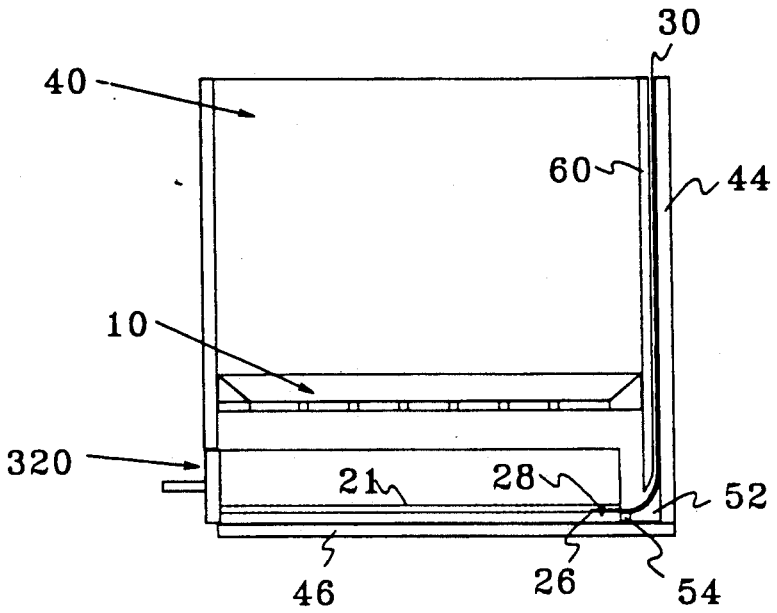

FIG. 5 shows a side view from the right side of the toy box with the right side cutaway. The drawer is in a closed position with the elongated flexible shroud receding into an opening between the true back and false back of the box.

Figure 6:
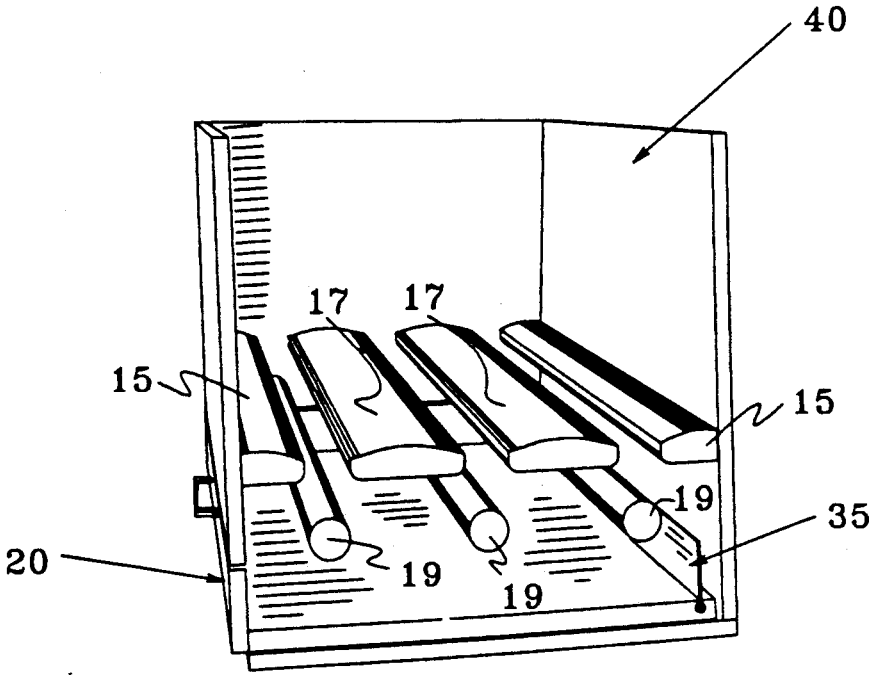

FIG. 6 shows an upper right hand perspective view of the toy box with the right side cutaway. The subfloor has grill style openings, with a second layer to help prevent large parts from partially falling through.

DETAILED DESCRIPTION

Figure 1:
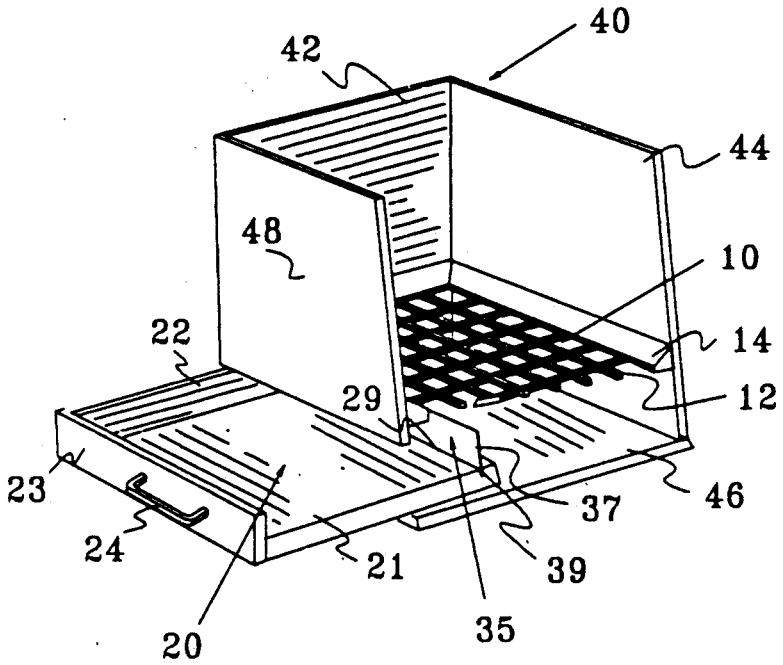
FIG. 1 shows an upper right hand perspective view of the toy box with the right side cutaway and the drawer in an open position. The subfloor is reticulated and the drawer does not address the problem of parts falling through when it is in an open position.
Figure 2:
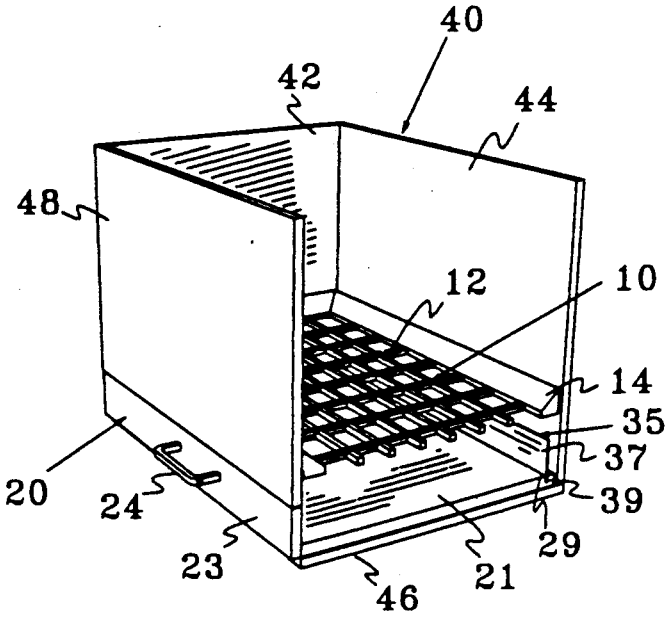
FIG. 2 shows an upper right hand perspective view of the toy box with the right side cutaway and the drawer in a closed position.

Referring to the accompanying drawings, FIG. 1 and FIG. 2, illustrate the toy box in a cutaway view, with the right side of the box removed. The walls 42, 44 & 48 are rigid planar surfaces standing in a vertical position and are assembled using common fastening methods dependent on the material used for construction. The top edges of walls 42, 44 & 48 are aligned for assembly. The base 46 is attached to the side walls 42 and rear wall 44 using the same method of fastening. The front wall 48, is shorter in height than the side walls 42 and back wall 44, of sufficient distance as to allow the drawer assembly 20 to fit between the lower edge of the front wall 48 and the floor 46 when the floor is attached to the side walls 42 and back wall 44. The grating assembly 10 is comprised of equally spaced crossed bars 12 arranged in such a manner as to leave openings between the parallel bars. The framing 14 slopes in and down from the top of the outer edge to the point that it meets the crossed bars 12. The grating assembly 10 can be fastened to the box assembly 40 using the same fastening methods as previously discussed, or could rest upon outcroppings in the walls 42, 44 & 48 for easy removal. The drawer assembly 20 consists of a rigid horizontal planar surface for the base 21, two rigid vertical planar surfaces as side walls 22 and a rigid vertical planar surface for the front wall 23. The drawer is assembled using common fastening methods. Attached to the center of the front wall 23 is a handle 24. The back of the drawer 35 is an extruded strip of polyurethane with a thin vertical planar surface 37 and a round base 39 when viewed from the end. The drawer back 35 is attached to the drawer base 21 by sliding the round of the drawer back 39 into a matching slot 29 formed in the drawer base 21 prior to the side walls 22 being attached.

Referring now to FIG. 3, FIG. 4 & FIG. 5, the box assembly 40 is assembled in the same manner as previously described. Added to this assembly 40 is a false back 60, leaving room between the true back 44 and the false back 60 of a determined distance. To the base 46 of the box assembly 40, three guide assemblies 50 comprised of a bar 54 and a concave surface 52 sloping upward, are attached. Spacing of the guide assemblies 50 coincide with the spacing of tracks 25 removed from the bottom of the drawer base 21. At a distance just above the drawer track 25, at the rear of the drawer base 21, a slot 26 is cut in the drawer base 21 horizontally. A plastic shroud 30 slides into the slot 26 and is attached to the drawer base 21 with pin fasteners 28. The plastic shroud 30 is semi-rigid with enough flexibility to bend around fairly tight corners, but rigid enough to hold weight. As the drawer assembly 320 is placed into the box assembly 40, the plastic shroud 30 rides along the shroud guides 54 on a horizontal plane until it meets the shroud planar guide 52 which then directs the plastic shroud 30 to a vertical plane upward. As the plastic shroud 30 travels in an upward vertical plane, it is hidden in a recess between the false back 60 and true back 44 of the box assembly 40. The grating assembly 10 is the same type as that previously described.

FIG. 6 depicts the same box assembly 40 and drawer assembly 20 previously described in detail. The grating is formed in a grill like manner, in two levels. The upper grate consists of elongated slats 15 & 17 mounted in a parallel fashion to one another. The elongated slats 15 & 17 slope downward to allow small toys to fall through the openings while holding larger toys on top. At a suitable distance below the elongated slats 15 & 17, elongated bars 19 are mounted in a parallel fashion to one another and parallel to the elongated slats 15 & 17. The bars 19 are placed at a suitable distance from the elongated slats 15 & 17 that will permit smaller toys to fall through the openings between the bars 19 and the elongated slats 15 & 17 while at the same time retaining larger toys from protruding downward into the drawer 20 area. Connection of the elongated slats 15 & 17 and the elongated bars 19 to the box is with suitable fasteners for the material used to construct the box 40. Either type drawer assembly 20 or 320 previously described, could be used with the grill arrangement of FIG. 6.

OPERATION

The toy box functions in much the same way as a normal toy box, in that toys are placed within the toy box from above and are retained there by the surrounding walls and base. The main difference in this invention is the subfloor 10 in the form of an open grid structure that is mounted above the movable tray 20. When toys of all sizes are placed in the toy box from above, small toys, as they filter through to the bottom, fall through the openings of the grid to the tray below. As there are many configurations of toys, consideration must be made for those toys that are long and thin enough to protrude through the openings in the grid 10 to the tray 320 below. To prevent these types of toys from obstructing the trays 320 opening, a flexible back 35 is mounted to the drawer 320. When the drawer 320 is opened and encounters one of these obstructions, the flexible back 35 gives way, and allows the drawer 320 to be opened. FIG. 3, 4 & 5 depict another solution to this problem and the problem of toys falling through the openings of the grid 10 when the drawer 320 is in an open state. By mounting a flexible, but somewhat stiff shroud 30 to the back of the drawer and eliminating a back wall to the drawer 320, protruding objects through the openings of the grid 10 from above cannot obstruct the drawers 320 movement and at the same time, this shroud 30 would catch any toys falling through when the drawer 320 is open. Upon closing the drawer 320, the shroud 30 slides into a recess at the back of the toy box 40 between the false back 60 and the true back 44. As the shroud 30 moves upward, the toys slide into the tray 320.

By way of illustration, the aforementioned toy box is depicted using common lumber construction methods, however, it is known that several plastic manufacturing processes could be employed to reduce manufacturing costs. In a preferred plastic embodiment of this invention, the walls, base and drawer would be constructed of blow molded plastic, which would also eliminate the need for the false back of FIGS. 3, 4 and 5. By cutting a slot in the lower inside portion of the box back, the hollow within the back would be used for storage of the plastic shroud. The gridwork depicted in FIGS. 1 thru 5, is a natural candidate for the injection molding process. The grillwork of FIG. 6, although depicted in a particular shape, it is foresee that this arrangement could take many different forms.

Although only two embodiments of the invention are described in detail herein, various modifications and variations can be made without exceeding the scope of the present invention.

What is claimed is:

1. A toy box comprising:
   - a container having four walls and a base, said four walls being disposed adjacent to said base to form, in cooperation with said base, said toy box;
   - a first of said four walls having an opening;
   - a tray received in said container and arranged to be movable through said opening for gaining access to toys stored in said tray; and,
   - a grill structure mounted in said container above said tray and configured to permit smaller toys to fall therethrough while retaining larger toys thereon;
   - wherein said tray is disposed between said base and said grill structure and includes a flexible lip mounted thereon, said lip operating to retain smaller toys in said tray while yielding during tray movement to interfering objects protruding through said grill structure.

2. The toy box of claim 1 wherein the flexible lip is mounted adjacent to and upwardly extending from the rear edge of the tray, thereby defining a flexible rear wall for toy retention.

3. The toy box of claim 1 wherein said tray is disposed between said base and said grill structure, the toy box further including a flexible shroud mounted thereon, said shroud being received in a recess in a second of said walls when said tray is closed, said shroud being withdrawn from said recess to retain toys on an upper surface of said shroud when said tray is opened.

4. The toy box of claim 3 wherein the tray is devoid of a rear wall and the flexible shroud is formed of a generally planar sheet-like material attached to the tray adjacent the rear edge thereof, the shroud thereby retaining small toys upon its surface when the tray is opened.

5. A toy box comprising:
   - a container having four walls and a base, said walls being adjacent to the base to form a rectangular cavity for the storage of toys;
   - one of said walls having an opening;
   - a shallow tray disposed in said cavity near said base and arranged for sliding movement through said opening to gain access to toys stored in said tray; and,
   - a grill structure mounted in said cavity above said tray and having openings therethrough to permit smaller toys to fall through said grill structure while retaining larger toys thereon;
   - wherein said grill structure includes a first set of bars arranged in a parallel, spaced relationship one to the other and further including a second set of bars arranged in a parallel, spaced relationship one to the other, at least one bar in said first set intersecting at least one bar in said second set at an included angle of between 10 degrees and 90 degrees.

6. The toy box of claim 5 wherein the first set of bars and the second set of bars are interconnected to define a lattice assembly having a perimeter edge conforming generally to the shape of the cavity, the lattice assembly having openings therethrough for permitting smaller toys to fall to the tray.

7. The toy box of claim 5 wherein the grill structure includes a set of elongate slats mounted in the cavity intermediate the base and the top edge and arranged in a parallel, spaced relationship one to the other and further includes a set of elongate bars mounted in the cavity intermediate the base and the top edge and arranged in a parallel, spaced relationship one to the other.

8. The toy box of claim 7 wherein the set of elongate bars is mounted intermediate the base and the set of elongate slats.

9. The toy box of claim 8 wherein the longitudinal axes of the slats and the bars are generally parallel to one another and generally perpendicular to two walls of the box.

10. The toy box of claim 6 wherein the tray is disposed between the base and the grill structure and includes a flexible lip mounted thereon, the lip operating to retain smaller toys in the tray while yet yielding during tray movement to interfering objects protruding through the grill structure.

11. The toy box of claim 10 wherein the flexible lip is mounted adjacent to and upwardly extending from the rear edge of the tray, thereby defining a flexible rear wall for toy retention.

12. The toy box of claim 6 wherein said tray is disposed between said base and said grill structure, said tray including a flexible shroud mounted thereon, said shroud being received in a recess in a second of said walls when said tray is closed, said shroud being withdrawn from said recess to retain toys on the upper surface of said shroud when said tray is opened.

* * * * *